US009692169B2

(12) United States Patent
Kroeckel et al.

(10) Patent No.: US 9,692,169 B2
(45) Date of Patent: Jun. 27, 2017

(54) CONNECTION SYSTEM BETWEEN AN ELECTRICAL OR ELECTRONIC DEVICE AND A PLUG CONNECTOR UNIT AND USE OF THE CONNECTION SYSTEM

(71) Applicant: Robert Bosch GmbH, Stuttgart (DE)

(72) Inventors: Markus Kroeckel, Schwieberdingen (DE); Michael Schoenfeld, Leinfelden-Echterdingen (DE); Richard Gueckel, Schwieberdingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/034,107

(22) PCT Filed: Sep. 29, 2014

(86) PCT No.: PCT/EP2014/070744

§ 371 (c)(1),
(2) Date: May 3, 2016

(87) PCT Pub. No.: WO2015/067409

PCT Pub. Date: May 14, 2015

(65) Prior Publication Data

US 2016/0285195 A1 Sep. 29, 2016

(30) Foreign Application Priority Data

Nov. 11, 2013 (DE) ..... 10 2013 222 817

(51) Int. Cl.
*H01R 13/52* (2006.01)
*H01R 13/629* (2006.01)

(52) U.S. Cl.
CPC ..... *H01R 13/52* (2013.01); *H01R 13/521* (2013.01); *H01R 13/5219* (2013.01); *H01R 13/629* (2013.01); *H01R 13/62944* (2013.01)

(58) Field of Classification Search
CPC ..... H01R 13/5219; H01R 13/6272; H01R 13/641; H01R 13/639; H01R 13/4223; H01R 13/4365; H01R 13/4364
See application file for complete search history.

(56) References Cited

U.S. PATENT DOCUMENTS 5,145,410 A * 9/1992 Maejima ..... H01R 13/5208 439/274
7,727,016 B2 * 6/2010 Lamdiziz ..... H01R 13/506 439/271

(Continued)

FOREIGN PATENT DOCUMENTS

DE 29510247 8/1995
DE 4434030 3/1996

(Continued)

OTHER PUBLICATIONS

International Search Report dated Jan. 7, 2015 of the corresponding International Application PCT/EP2014/070744 filed Sep. 29, 2014.

*Primary Examiner* — Xuong Chung Trans
(74) *Attorney, Agent, or Firm* — Gerard Messina

(57) ABSTRACT

A connection system between an electrical or electronic device and a plug connector unit, the device including first electrical terminals, which are aligned in parallel to one another with the aid of a first positioning device within a connection area of the device, and second electrical terminals, which cooperate with the first electrical terminals, being aligned with the first electrical terminals with the aid of a second positioning device in a plug connector housing of the plug connector unit.

11 Claims, 3 Drawing Sheets

(56) References Cited

U.S. PATENT DOCUMENTS

| | | | | |
|---|---|---|---|---|
| 9,257,781 | B2 * | 2/2016 | Pade ..... | H01R 13/5208 |
| 2002/0101041 | A1 | 8/2002 | Kameyama | |
| 2005/0250364 | A1 | 11/2005 | Kameyama et al. | |
| 2006/0270255 | A1 | 11/2006 | Ishikawa et al. | |

FOREIGN PATENT DOCUMENTS

| | | |
|---|---|---|
| DE | 19743104 | 4/1999 |
| DE | 10025841 | 12/2000 |
| DE | 102005057952 | 6/2007 |
| WO | WO 2013/135419 | 9/2013 |

* cited by examiner

CONNECTION SYSTEM BETWEEN AN ELECTRICAL OR ELECTRONIC DEVICE AND A PLUG CONNECTOR UNIT AND USE OF THE CONNECTION SYSTEM

FIELD

The present invention relates to a connection system between an electrical or electronic device and a plug connector unit. The present invention further relates to the use of a connection system according to the present invention.

BACKGROUND INFORMATION

In a conventional connection system, in applications in automotive engineering, an electrical or electronic control unit is connected to a plug connector of a cable harness of the motor vehicle. In such applications, first electrical terminals are situated in parallel to one another within a terminal area of the device with the aid of a first positioning device. In particular, the electrical terminals are formed as pin-shaped tag connectors. For contacting using appropriate second electrical terminal elements, in particular in the form of socket-type elements, the second terminal elements are aligned in parallel to the first electrical terminals in a plug connector housing of the cable harness plug with the aid of a second positioning device. When the electrical terminals are connected, it is essential for them to be guided together in their correct position to one another, and held in fixed position during the connecting, in order to establish a secure electrical connection over the entire period of operation of the electrical device. This is achieved with the aid of the mentioned positioning devices, which fix the first and the second electrical terminals in both their axial direction and in their horizontal plane (in relation to the longitudinal axes of the terminal elements), for example, by a clamping connection or by insert molding using the material of the particular positioning device.

Depending on the use of the device, there are typically two different configurations, in which either a connection is required between the device and the plug connector unit which is sealed against environmental influences, or a connection in which leak tightness is not required. Typically, tight systems are always required when, due to the installation location or the conditions of use, the entry of moisture or dirt into the area between the electrical terminals is to be avoided, in order to be able to constantly protect the electrical connection securely and reliably. For this reason, conventionally, a connection system is formed in such a way, that in addition to the second positioning device in the plug connector unit (cable harness plug connector), a sealing element is situated on the side facing the first terminals in the electrical or electronic device, which ensures the necessary leak tightness. Such a sealing element is known as a so-called "sealing mat" and simultaneously includes guidance properties for the second connecting elements, in order to bridge the axial distance between the positioning devices. It is also customary in such a connection system to provide an additional, in particular, radially circumferential sealing element between the device and the plug connector unit, which seals the connection area between the above-named components. If for reasons of standardization and/or cost, it is intended to use the conventional connection system also for connection systems, in which a certain leakiness is allowed, it is thus not possible to use it by simply omitting the sealing element (sealing mat), since the elimination of the sealing element would make the axial distance between the two positioning devices so great that an unambiguous positioning of the second electrical terminals within the plug connector unit is no longer ensured. This results in the risk that the electrical terminals would no longer be positioned in relation to one another with sufficient precision when being connected.

SUMMARY

An object of the present invention is to refine a connection system between an electrical or electronic device and a plug connector unit in such a way that it is suitable for making possible both a sealed connection, as well as a connection allowing a certain leakiness, between the electrical terminals using the same device and the same plug connector housing of the plug connector unit.

According to the present invention, this objective may be achieved by a connection system in accordance with example embodiments of the present invention, in that the plug connector housing of the plug connector unit is designed for either accommodating a sealing element, which surrounds the second electrical terminals on the side facing the first electrical terminals between the two positioning devices, or instead of the sealing element, a second positioning device modified in relation to the second positioning device or a bridge element may be inserted into the plug connector housing of the plug connector unit, the overall height of the modified second positioning device or of the second positioning device and of the bridge element at least essentially corresponding to the sum of the height of the second positioning device and the height of the sealing element in the direction of the longitudinal extension of the second electrical terminals.

In other words, this means that instead of a sealing element in the plug connector housing of the plug connector unit, as used in a tight connection between the electrical terminals, a modified second positioning device or a bridge element is inserted in combination with a second positioning device, which provides for the positioning of the second electrical terminals in relation to the first electrical terminals, in that the bridge element shortens the axial distance to the first positioning device.

It is very particularly preferred if the second modified positioning device is designed as a single-piece component. This means in the simplest case that the second positioning device has been designed to have a greater height in a design that is not leak proof. This has the advantage that only a single element must be mounted, which provides for the precise positioning of the second electrical terminals in the plug connector housing of the plug connector unit.

Furthermore, a particularly simple and cost-effective structural design of the connection system may be achieved if the connection area between the terminal area of the device and the plug connector housing of the plug connector unit is designed without sealing elements designed as separate components.

In order to achieve a positioning of the concerned components in the connection area, it is provided that the terminal area of the device and the plug connector housing of the plug connector unit may be positioned in relation to one another by contact in certain areas of the terminal area and/or of the device on the plug connector unit 20.

In an embodiment of a preferred structural design of the positioning, it is provided that the terminal area of the device and/or the plug connector housing of the plug connector unit has deformable positioning segments formed integrally thereon.

It is preferred in particular if the plug connector housing and/or the terminal area of the device is/are made of a thermoplastic material.

To achieve a secure connection between the device and the plug connector unit and to ensure a setpoint position between the above-named components in one connection direction, it is furthermore provided in one advantageous embodiment of the present invention that the plug connector housing and the terminal area of the device may be connected and locked to one another with the aid of a mechanical locking device, with mutually interacting stop elements being provided which position the plug connector housing in relation to the terminal area in the connection direction.

In particular, the two positioning devices may have receptacles designed as passage openings for the electrical terminals. The electrical terminals may be fixed or positioned in the passage openings by using either an appropriate clamping connection or preferably by insert molding the electrical terminals using the material of the positioning devices.

Particularly preferred is the use of a connection system according to the present invention in a motor vehicle as a connection between an electronic control unit and a vehicle-side cable harness.

Additional advantages, features and details of the present invention ensue from the following description of preferred exemplary embodiments and with reference to the figures.

BRIEF DESCRIPTION OF THE DRAWINGS

Identical elements or elements having an identical function are provided with the same reference numerals in the figures.

DETAILED DESCRIPTION OF EXAMPLE EMBODIMENTS

Figure 1:
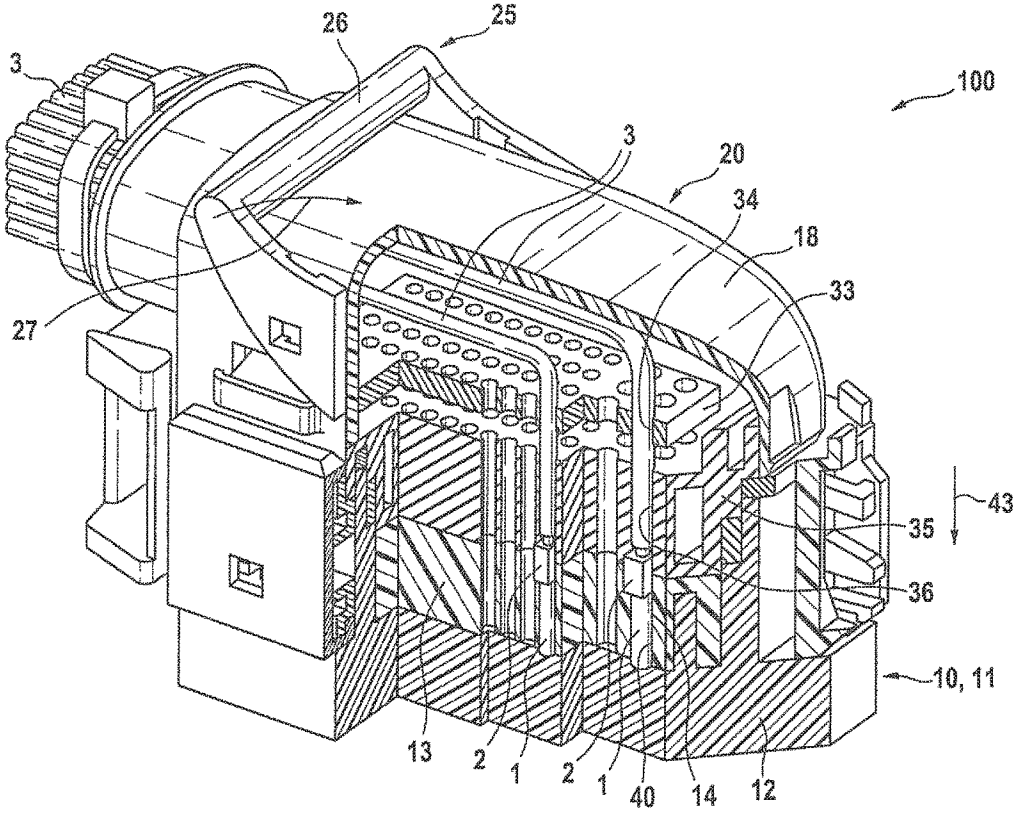
FIG. 1 shows a perspective view in partial section of a first connection system according to an example embodiment of the present invention.

Connection system 100 shown in FIG. 1 is preferably used in a motor vehicle as a connection between an electronic control unit and a vehicle-side cable harness. The electronic control unit, which is denoted in the following simply as device 10, has a housing 11, which is not shown in detail, including a terminal area 12. At least terminal area 12 is made of plastic, in particular a thermoplastic material, and is manufactured by an injection molding process. Within terminal area 12, a plurality of first electrical terminals 1 are situated, in particular in the form of pin-shaped tag connectors or the like, which are aligned in parallel to one another with respect to their longitudinal axes. Within terminal area 12, a first positioning device 13, which fixedly accommodates first electrical terminals 1, is used for this purpose, in that first electrical terminals 1 are accommodated, at least in areas, in passage openings 14 of first positioning device 13, for example, by a clamping connection, or preferably by insert molding using the material of first positioning device 13. First electrical terminals 1 project only over a partial area of the height of terminal area 12, for example, approximately to the center of terminal area 12.

First electrical terminals 1 cooperate with second electrical terminals 2, which are situated within a plug connector housing 18 of a plug connector unit 20 in the form of a cable harness plug connector. Second electrical terminals 2 contact first electrical terminals 1, for example, in the manner of a socket. Second electrical terminals 2 are connected electrically to ends of cables 3, which protrude from plug connector housing 18 on the side facing away from second electrical terminals 2. In the exemplary embodiment, cables 3 protrude from plug connector housing 18 perpendicularly to the longitudinal direction of second electrical terminals 2; of course, however, configurations are also possible in which cables 3 are aligned for example, in parallel to second electrical terminals 2.

Figure 5:
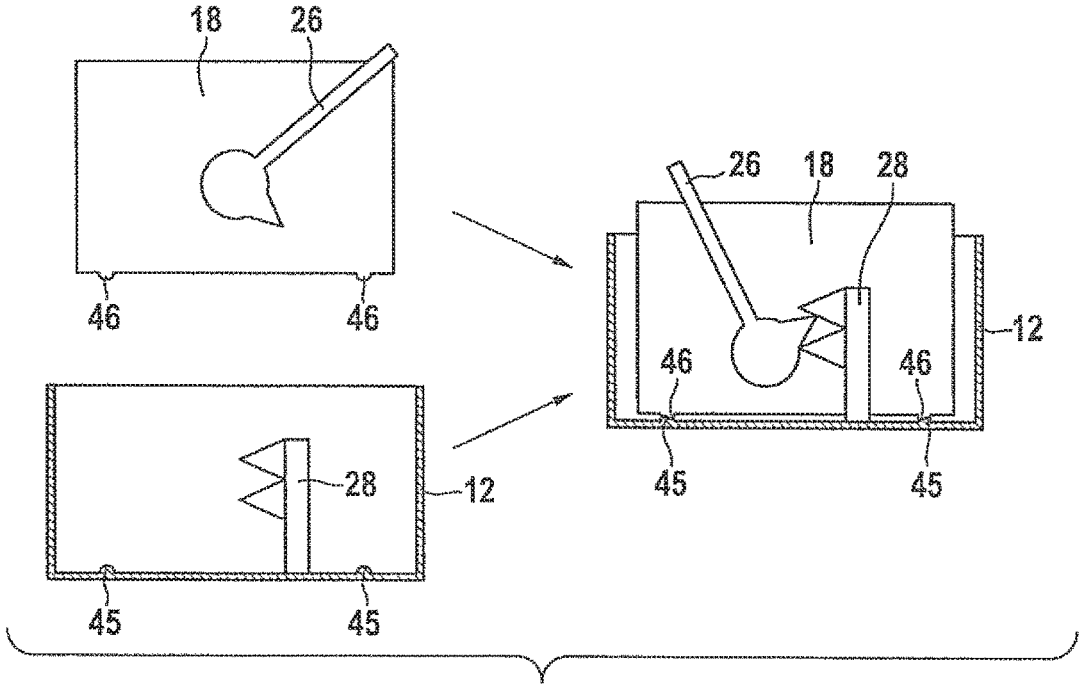
FIG. 5 shows a simplified representation of the connection between the housing of the electrical device and the plug connector unit according to FIG. 4 in longitudinal section.

Plug connector unit 20 or plug connector housing 18 is preferably also made from a thermoplastic material and has a locking device 25 including an actuating lever 26, which is situated pivotably on plug connector housing 18 in the direction of arrow 27. Furthermore, as is solely apparent based on FIG. 5, actuating lever 26 cooperates with a receptacle device 28 for actuating lever 26 situated in the area of terminal area 12 in a form-locked and force-fit manner.

Figure 2:
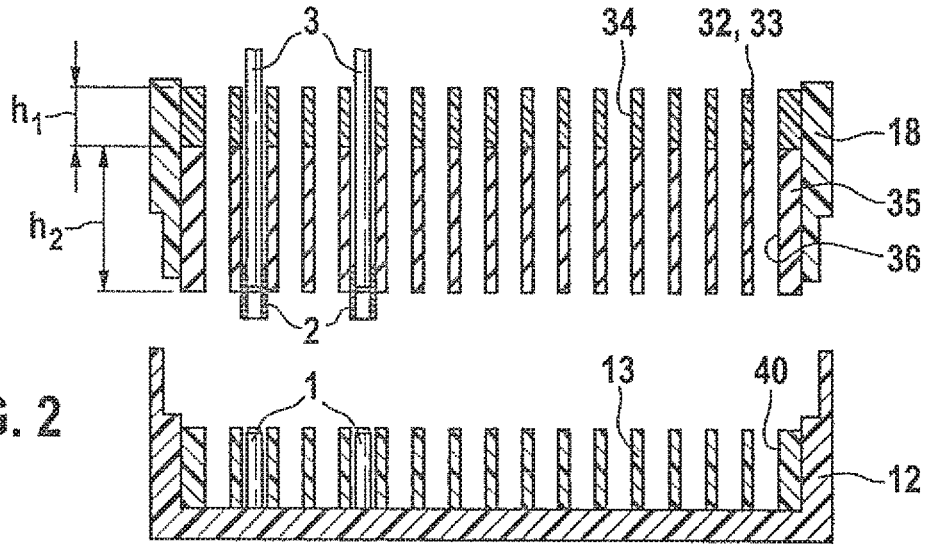
FIG. 2 and FIG. 3 each show different connection systems in a simplified representation using alternative positioning devices in the plug connector unit.

In a first use of connection system 100 according to the present invention, it is provided that second electrical terminals 2, as is evident from an overview of FIGS. 1 and 2, are fixedly accommodated within plug connector housing 18 with the aid of a second positioning device 32 in such a way that second positioning device 32 aligns second electrical terminals 2 with assigned first electrical terminals 1 in terminal area 12. In particular, it is apparent based on FIGS. 1 and 2 that second positioning device 32 is designed in the form of a holding plate 33, which similar to first positioning device 13, accommodates second electrical terminals 2 either by clamping in passage openings 34, or surrounds them by insert molding using the material of second positioning device 32.

In the case of unjoined terminals 1, 2, viewed in the direction of the longitudinal axes of electrical terminals 1, 2, between first positioning device 32 and a contact chamber 40 accommodating first electrical terminals 1, in which first electrical terminals 1 are accommodated using first positioning device 3, an axial distance is formed on the side facing away from first positioning device 13, which is bridged by a sealing element 35, which is particularly clearly apparent in FIG. 2. In alignment with passage openings 34 in second positioning direction 32, sealing element 35 also has passage openings 36, which surround second electrical terminals 2 and which guide second electrical terminals 2. Sealing element 35 is used for sealing the connection area between electrical terminals 1, 2 in order to ensure a secure and reliable electrical connection between electrical terminals 1, 2 over the entire period of operation. Based on FIG. 1, it is further apparent that sealing element 35 extends in axial direction at least almost directly to contact chamber 40. Sealing element 35 is fixedly accommodated within plug connector housing 18 by, for example, a form-locked or clamping connection, sealing element 35 usually being made from an elastic material.

According to the present invention, it is provided that in the case of a second use of connection device 100, no sealing element 35 is provided within plug connector housing 18. Instead, a modified positioning device 38 is used, which according to the representation of FIG. 3, has an enlarged extension or height in the axial direction compared to second positioning device 32. In particular, height H of modified second positioning device 38 according to FIG. 3, corresponds to height H, which according to FIG. 2 results from partial heights $h_1$ of second positioning device 32 and height $h_2$ of sealing element 35.

Figure 3:
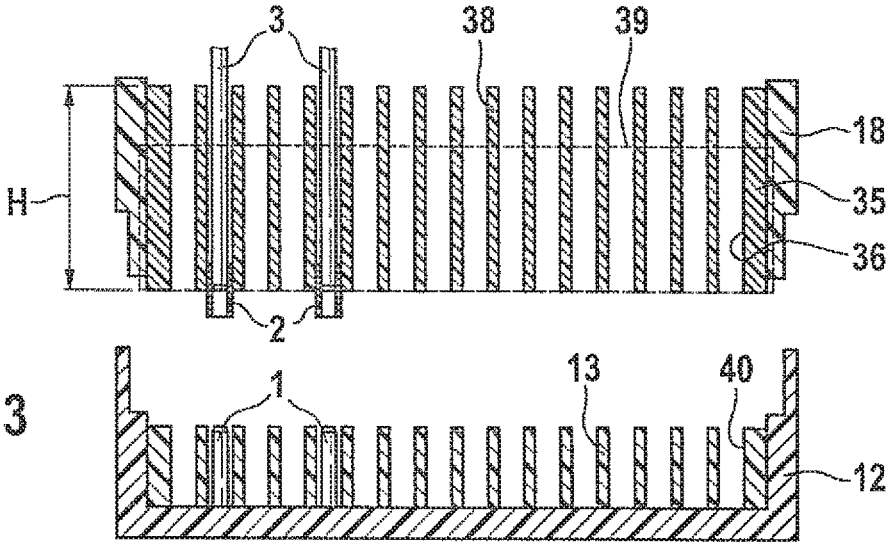

In the exemplary embodiment shown in FIG. 3, second positioning device 38 is formed in one piece. However, it may also be provided that, instead of an integral second positioning device 38, second positioning device 32 according to FIG. 2 is used, and a separate bridge element 39, which is only shown as a dashed line in the representation of FIG. 3, is used for bridging the axial distance between second positioning device 32 and contact chamber 40. Bridge element 39 is preferably designed identical to second positioning device 32, and if necessary, only has a different height.

Both bridge element 39 and second positioning device 38 are used for positioning or fixing second electrical terminals 2, similar to sealing element 35, in contact chamber 40 in alignment with first electrical terminals 1.

Figure 4:
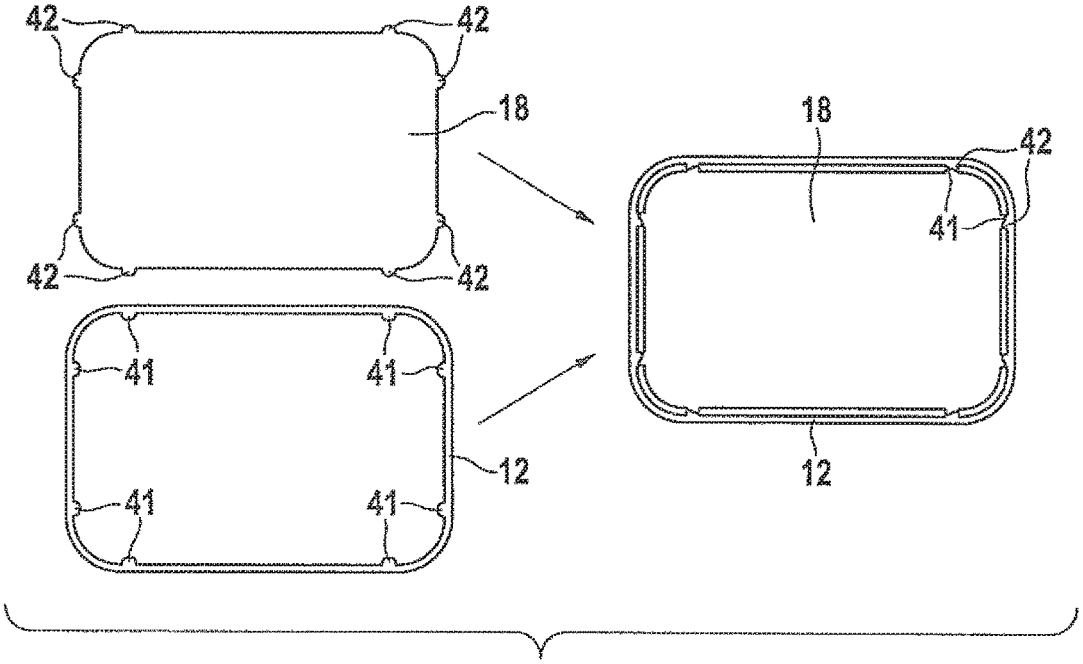
FIG. 4 shows a simplified representation of the connection between the terminal area of the housing and the plug connector unit in cross section.

According to the representation of FIG. 4, it may be provided that terminal area 12 has first positioning segments 41 on its inside, in particular in the corner areas, which are formed integrally on first terminal area 12. First positioning segments 41 cooperate with second positioning segments 42 also integrally formed on the outside of plug connector housing 18. When plug connector unit 20 or plug connector housing 18 are connected in the direction denoted by arrow 43 in FIG. 1, plug connector housing 18 is inserted into first terminal area 12 of device 10, positioning segments 42, 43 being operatively linked and plug connector housing 18 being aligned with first terminal area 12 and positioned with one another in a setpoint position. It may also be provided according to FIG. 5 that first stop elements 45 are formed on the bottom of first terminal area 12, which cooperate with second stop elements 46 preferably formed on plug connector housing 18, and which generate a defined contact force between first terminal area 12 and plug connector housing 18 when locking device 25 is actuated (by pivoting actuating lever 26).

Connection system 100 as described above may be changed or modified in various ways without departing from the inventive idea.

What is claimed is:

1. A connection system between an electrical or electronic device and a plug connector unit, wherein:

the device includes first electrical terminals aligned in parallel to one another with the aid of a first positioning device within a connection area of the device, and second electrical terminals, which cooperate with the first electrical terminals, and being aligned with the first electrical terminals with the aid of a second positioning device in a plug connector housing of the plug connector unit;

the plug connector housing of the plug connector unit: (i) is designed for accommodating a liquid-tight sealing element which surrounds the second electrical terminals on a side facing the first electrical terminals between the first and second positioning devices for providing a liquid-tight sealed connection, and (ii) is designed for accommodating, instead of the liquid-tight sealing element, a second positioning device modified in relation to the second positioning device or a bridge element inserted into the plug connector housing of the plug connector unit, an overall height of the modified second positioning device or the second positioning device and of the bridge element at least generally corresponding to a sum of a height of the second positioning device and a height of the sealing element in a direction of a longitudinal extension of the second electrical terminals, thereby making possible both a sealed connection, as well as an unsealed connection, using the same device and the same plug connector housing of the plug connector unit.

2. The connection system as recited in claim 1, wherein the second modified positioning device is designed as a single-piece component.

3. The connection system as recited in claim 1, wherein the connection area between the terminal area of the device and the plug connector housing of the plug connector unit is formed without sealing elements formed as separate components.

4. The connection system as recited in claim 3, wherein the terminal area of the device and the plug connector housing of the plug connector unit are positioned in relation to one another by contact in certain areas of one of the terminal area, and the device on the plug connector unit.

5. The connection system as recited in claim 4, wherein at least one of: i) the terminal area of the device, and ii) the plug connector housing of the plug connector unit, has deformable positioning segments formed integrally thereon.

6. The connection system as recited in claim 1, wherein at least one of: i) the plug connector housing, and ii) the terminal area of the device, is made of a thermoplastic material.

7. The connection system as recited in claim 1, wherein the plug connector housing and the terminal area of the device are connected and locked to one another with the aid of a mechanical locking device, mutually cooperating stop elements being provided which position the plug connector housing in relation to the connection area in the connection direction.

8. The connection system as recited in claim 1, wherein the first and second positioning devices have receptacles formed as passage openings for the electrical terminals.

9. The connection system as recited in claim 8, wherein the first and second electrical terminals are fixedly accommodated one of: i) by a press-fit connection in the passage openings, or ii) by insert molding using a material of the positioning device.

10. The connection system as recited in claim 1, wherein the connection system is in a motor vehicle as a connection between an electronic control unit and a vehicle-side cable harness.

11. A connection system in a motor vehicle between an electrical or electronic device and a plug connector unit, wherein:

the device includes first electrical terminals aligned in parallel to one another with the aid of a first positioning device within a connection area of the device, and second electrical terminals, which cooperate with the first electrical terminals, and being aligned with the first electrical terminals with the aid of a second positioning device in a plug connector housing of the plug connector unit;

the plug connector housing of the plug connector unit: (i) is designed for accommodating either a liquid-tight sealing element which surrounds the second electrical terminals on a side facing the first electrical terminals between the first and second positioning devices for providing a liquid-tight sealed connection, and (ii) is designed for accommodating, instead of the liquid-tight sealing element, a second positioning device modified in relation to the second positioning device or a bridge element inserted into the plug connector housing of the plug connector unit, an overall height of the modified second positioning device or the second positioning device and of the bridge element at least generally corresponding to a sum of a height of the second positioning device and a height of the sealing element in a direction of a longitudinal extension of the second electrical terminals, thereby making possible both a sealed connection, as well as an unsealed connection, using the same device and the same plug connector housing of the plug connector unit;

the connection system providing a connection between an electronic control unit and a vehicle-side cable.

* * * * *